US006328174B1

(12) United States Patent
Marangoni Graziani et al.

(10) Patent No.: US 6,328,174 B1
(45) Date of Patent: Dec. 11, 2001

(54) SEALED CLOSURE CAP

(75) Inventors: Antonio Marangoni Graziani, deceased, late of Barcelona (ES), by Graziella Tosi, Maurizio Marangoni, legal heirs; by Cristina Marangoni, legal heiress, Valledoria (IT); José Luis Gomez Cao, Molins de Rei (ES)

(73) Assignee: Diseno Industrial Mago. S.L., Sant Joan Despi (ES)

( * ) Notice: Subject to any disclaimer, the term of this patent is extended or adjusted under 35 U.S.C. 154(b) by 0 days.

(21) Appl. No.: 09/117,277

(22) PCT Filed: Nov. 21, 1997

(86) PCT No.: PCT/ES97/00285

§ 371 Date: Aug. 10, 1999

§ 102(e) Date: Aug. 10, 1999

(87) PCT Pub. No.: WO98/23494

PCT Pub. Date: Jun. 4, 1998

(30) Foreign Application Priority Data

Nov. 25, 1996 (ES) ..... 9603012 U
Nov. 7, 1997 (ES) ..... 9702330

(51) Int. Cl.[7] ..... B65D 51/18; B65D 45/30
(52) U.S. Cl. ..... 215/249; 215/251
(58) Field of Search ..... 215/247, 249, 215/250, 251, 277, 278, 296, DIG. 3, 272, 275

(56) References Cited

U.S. PATENT DOCUMENTS

| | | | | |
|---|---|---|---|---|
| 3,905,502 | * | 9/1975 | Wassilieff | 215/272 |
| 4,192,428 | * | 3/1980 | Segmuller | 215/272 |
| 4,251,003 | * | 2/1981 | Bodenmann | 215/272 |
| 4,456,143 | | 6/1984 | Davis et al. . | |
| 5,307,945 | | 5/1994 | Hidding et al. . | |
| 5,314,084 | | 5/1994 | Folta et al. . | |
| 5,316,163 | * | 5/1994 | von Schuckmann | 215/277 |
| 5,522,518 | | 6/1996 | Konrad et al. . | |
| 5,615,788 | * | 4/1997 | Larguia | 215/272 |
| 5,813,554 | * | 9/1998 | Graziani et al. | 215/274 |
| 5,879,345 | * | 3/1999 | Aneas | 215/277 |
| 5,957,314 | * | 9/1999 | Nishida et al. | 215/275 |
| 5,960,972 | * | 10/1999 | Larguia, Sr. | 215/272 |

FOREIGN PATENT DOCUMENTS

| | | |
|---|---|---|
| 378488 | 1/1990 | (EP) . |
| 434655 | 11/1990 | (EP) . |
| 807585 | 11/1997 | (EP) . |
| 1024427 | 4/1993 | (ES) . |
| 1030658 | 3/1995 | (ES) . |
| 1034959 | 8/1996 | (ES) . |

* cited by examiner

*Primary Examiner*—Nathan J. Newhouse
(74) *Attorney, Agent, or Firm*—Klauber & Jackson

(57) ABSTRACT

The sealed closure cap applies specially to containers or bottles which contain carbonated beverages, and has a central neck (6) intented to be introduced into container mouth (2), and an external enveloppe provided with retention means (8, 20) in counterforms of the external surface of the bottle neck, with additional locking means (18, 18') which ensure the closing position. The cap incorporates an overcap (3, 3') carrying the seal ring (4, 4') which surrounds axial fins (7, 8, 20) of the main body of the cap (1, 1'), and can adopt a lower position or nesting position with respect to the cap (1) itself in order to lock the retention means (8, 20) to the external part of the container (2, 22). During the unsealing operation and opening of the cap, the overcap (3, 3') can be displaced without being detached, in an axial path limited by stops (12, 17), appropriately guided and by means of a threading provided on the complementary surfaces of both components. The opening and closing can be done repeatedly with great easy.

11 Claims, 8 Drawing Sheets

SEALED CLOSURE CAP

OBJECT OF THE INVENTION

As expressed in the title of this specification, the present invention consists of an airtight stopper and as such provides a series of relevant and advantageous characteristics with regard to those that presently exist for the same purpose and which are of the same type.

This stopper is especially applicable to all types of carbonated beverages (champagne, sparkling wines, beer, carbonated drinks, etc.), having the purpose, aside from ensuring perfect closing that prevents accidental opening of the stopper by an accumulation of overpressure inside the container or vessel that closes, that the container can easily be closed again for subsequent use, until the contained liquid is consumed, without losing the gas, that is to say, without the gaseous content dissipating from the container.

In the specific case of champagne and sparkling wine, contained in bottles that are normally closed by a cork stopper (very costly), upon the stopper being replaced by the one that the invention proposes, effectiveness and greater economy are likewise achieved.

BACKGROUND OF THE INVENTION

Utility model no. 9,602,251 claimed a stopper of this type, which had an inside tubular wall for insertion in the mouth of the bottle or container, and another outside covering that was placed around the neck of the container, having some through windows through which respective teeth of some radial tongues that could articulate in their connecting line with the top part of the outside covering itself, entered. Once these teeth that passed through the cited windows, they became housed under the ring-shaped projection conventionally provided for on the outside of the neck of the bottle or container, maintaining the retaining position by means of a ring that moved axially in order to remain overlying the tongues, preventing the teeth from coming out of their housing.

Spanish utility model no. 9,500,853 contemplates a ring-shaped seal with a central tubular rod that seals the mouth of the bottle and whose walls are provided with circular ribs, to provide greater airtightness. In the top part it has a ring-shaped flange from which descend some wings that are place around the mouth of the bottle until the first recess where the stoppers are of another type normally fasten by different processes. This body of the stopper is completed with another top one that constitutes a ring that is connected by means of some tearable points, which break when the ring is pushed in the packaging operation to remain fitted blocking the descending wings of the bottom body, this airtight closing position remaining until it is not released again upon being moved in the opposite direction, or broken.

U.S. Pat. Nos. 4,456,143, 5,314,084 and 5,522,518 also refer to stoppers and closing systems that reflect the prior art related to the patent of invention applied for over which the latter provides outstanding advantages.

DESCRIPTION OF THE INVENTION

In broad outline, the improved stopper that constitutes the object of the invention, presents as a special characteristic, the inclusion of an independent top cap that is connected to the rest of the stopper in the bottling stage, this cap in turn supporting the sealing ring. In the coupling position, coinciding with its bottommost location with regard to the bottle, once the stopper is closing the neck of the bottle or container, this cap keeps the retaining means of the stopper itself blocked. The cap includes a discoidal closing surface, from the bottom of which originates the cylindrical wall or neck that is inserted inside the container to close its mouth, there being parallel to this cylindrical surface some tongues which in their inside part support the teeth which are to remain retained in the ring-shaped recess of the neck of the bottle or container. Precisely due to the presence of the contained gas, it is necessary that such lugs are kept blocked in order to prevent the accidental discharge of the stopper, which is achieved upon placing the cap in the correct position.

The discoidal sealing surface of the stopper has at the top a tubular portion that has an outside ring-shaped projection in order to constitute the retaining means of the cap in the uppermost position of the same, the cap being axially movable from a bottom closing and sealing position of the peripheral tongues, up to another top position that permits removal of the stopper, or the opening of the bottle or container.

The cap has in the center a threaded axial projection for connection thereof in the threaded inside of the top tubular portion of the stopper itself. In a position coaxial to this threaded projection, there are other axial tongues whose ends finish in a spear tip, in a similar way that the retaining tongues have in the ring-shaped recess of the bottle neck, naturally emerging from the bottom of said cap. These tongues are duly guided in a ring-shaped part that forms part of the stopper itself, placed in the top part of the same and that keeps them in an axial position, preventing their deviation. These spear tipped projections will remain located between the discoidal surface of the stopper itself and the ring-shaped projection of the top tubular portion of the same, determining the distance at which these cited elements are located, the axial path of the cap.

The approximation of the cap so that its ring-shaped flap surrounds the neck of the container or bottle in order to ensure the sealing thereof, in a closing operation subsequent to the opening operation, is achieved once the container or bottle is closed, first with a slight axial movement and then by screwing. The same thing happens when opening the bottle or container, in the initial breaking of the seal and the different times when the bottle is opened until the contained liquid is consumed. Naturally in the latter opening operations the sealing ring is detached or broken and the ring remains on the neck or is thrown away.

The ring-shaped part that keeps the tongues of the cap together, preventing them from coming off the ring-shaped tooth of the top tubular portion of the stopper itself, is connected to the rest of the stopper by easily breakable portions, this breaking taking place in the initial assembly of the stopper, in the bottling factory. This ring-shaped part is formed in the injection molding process itself of the stopper itself and advantageously the easily breakable ribs or portions emerge from the edge of the tooth or ring-shaped projection of the outside of the top tubular portion or neck of the stopper itself, these ribs breaking when sealing itself takes place upon axially introducing the cap.

Forward and backward movement of the cap with regard to the main body of the stopper, which happens by means of screwing, can also be achieved more effectively upon providing that the retaining tongues are formed by means of axial cuts in the outside covering of the main body, whose outside periphery is fitted with a thread that connects with the one existing on the inside edge of the cap.

In the last case referred to the sealing ring remains connected to the cap where the threaded area ends and the inviolability is ensured due to the fact that it remains retained by its bottom edge on the neck itself of the bottom or container.

In order to provide a better understanding of the features of the invention and forming an integral part of this specification, some sheets of drawings, in whose figures the following has been represented in an illustrative and non-restrictive manner, are attached hereto.

DESCRIPTION OF THE PREFERRED EMBODIMENT

Figure 1:
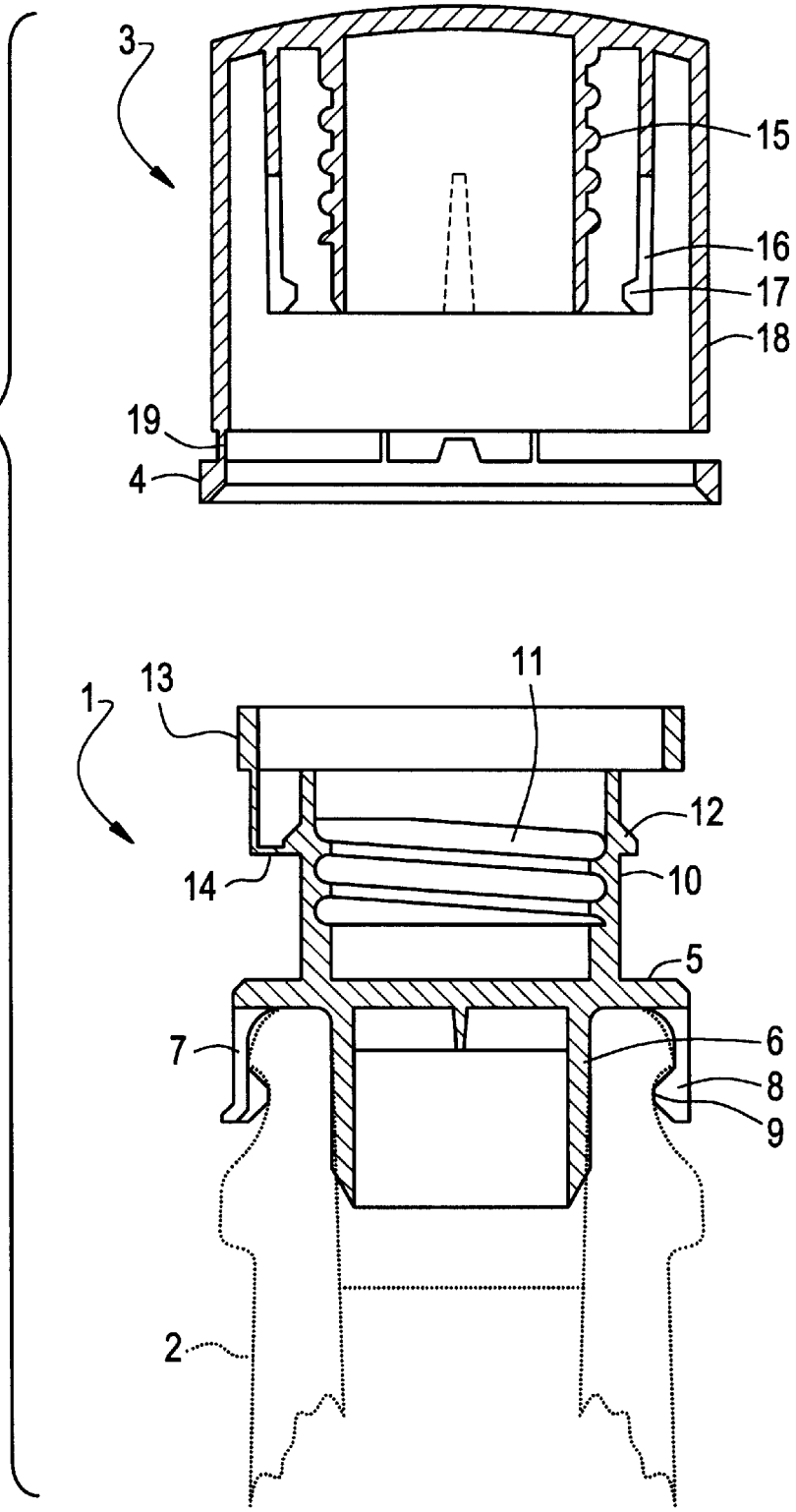
FIG. 1 is an exploded section view of the two component parts of the stopper, object of the invention.
Figure 2:
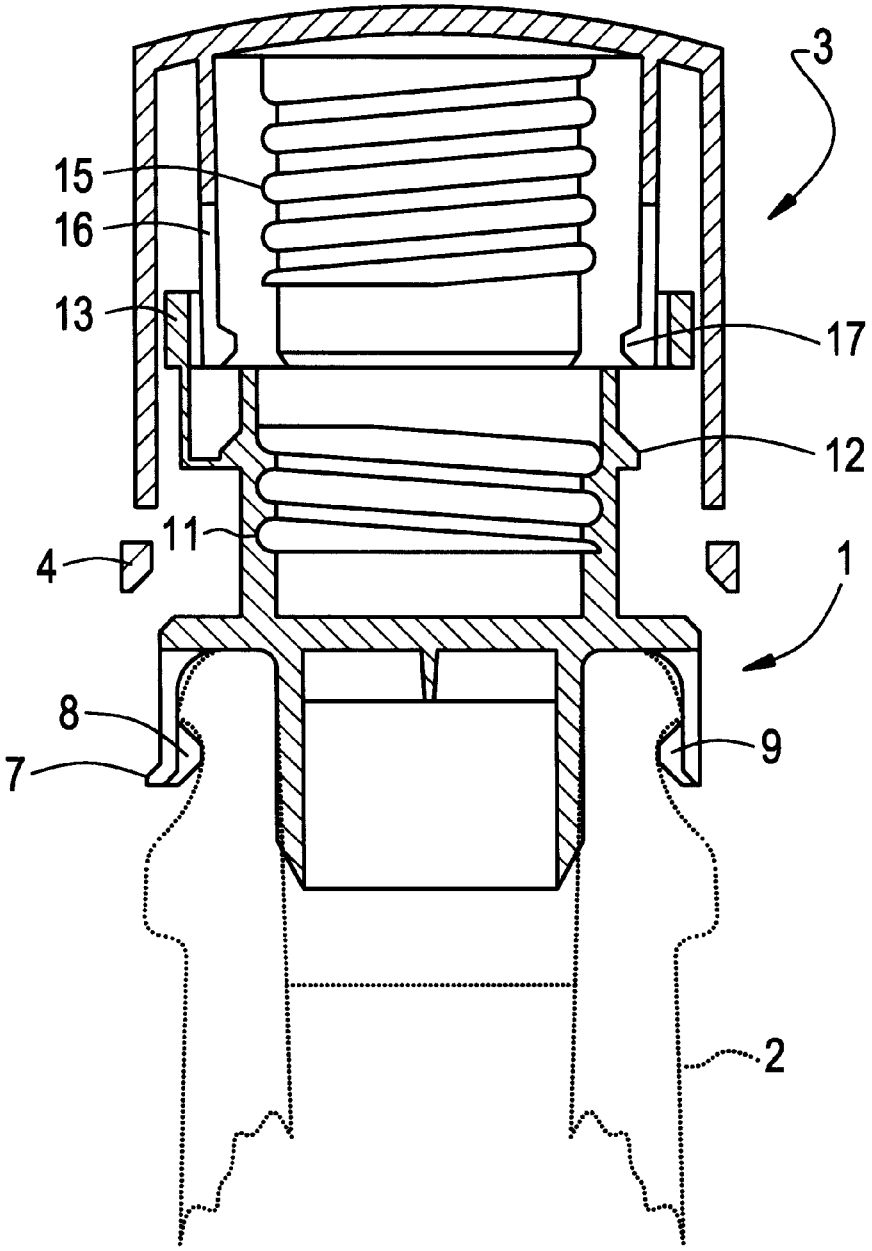
FIGS. 2, 3 and 4 are respective sequential views of the connection between both component parts of the same stopper of FIG. 1.
Figure 3:
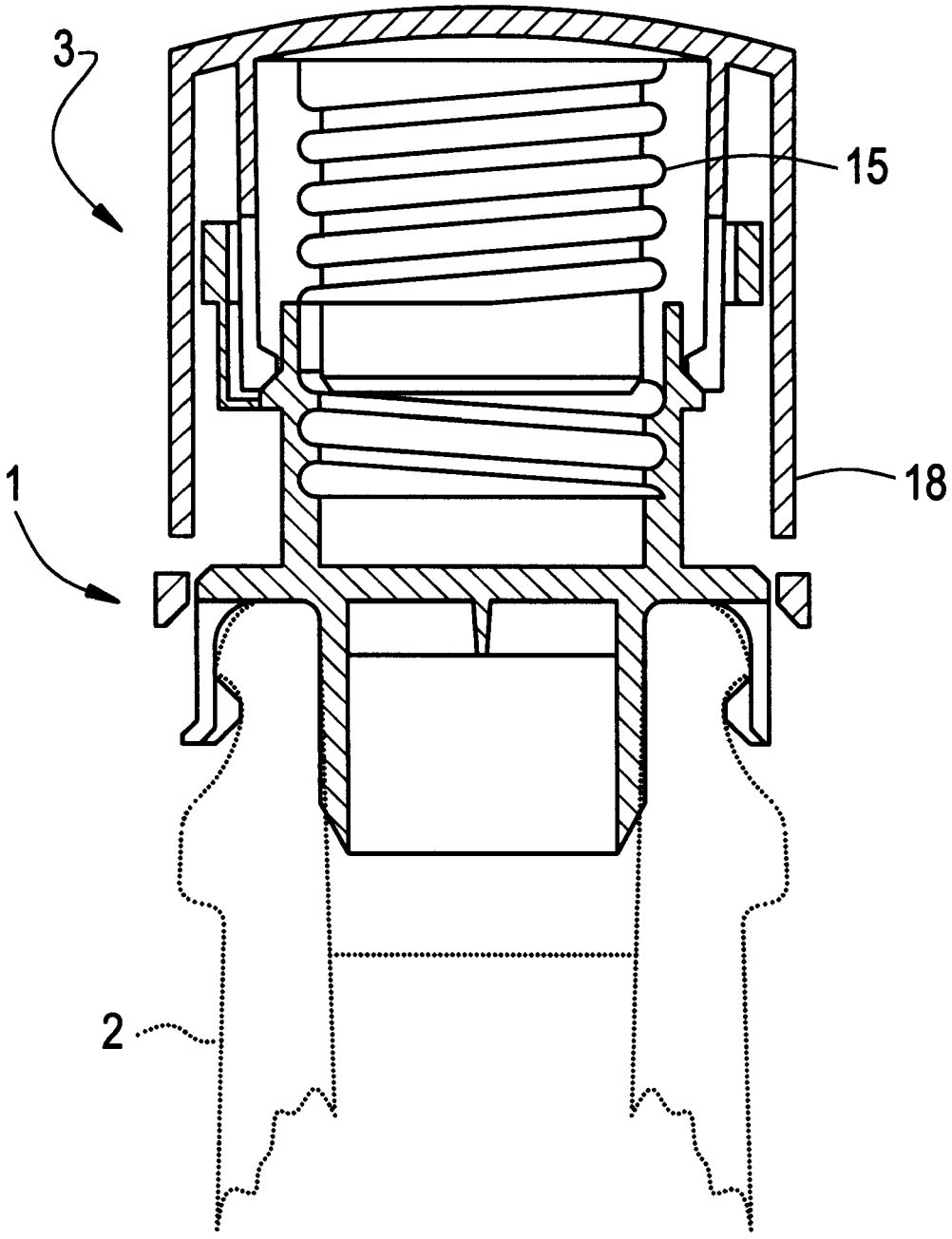
Figure 4:
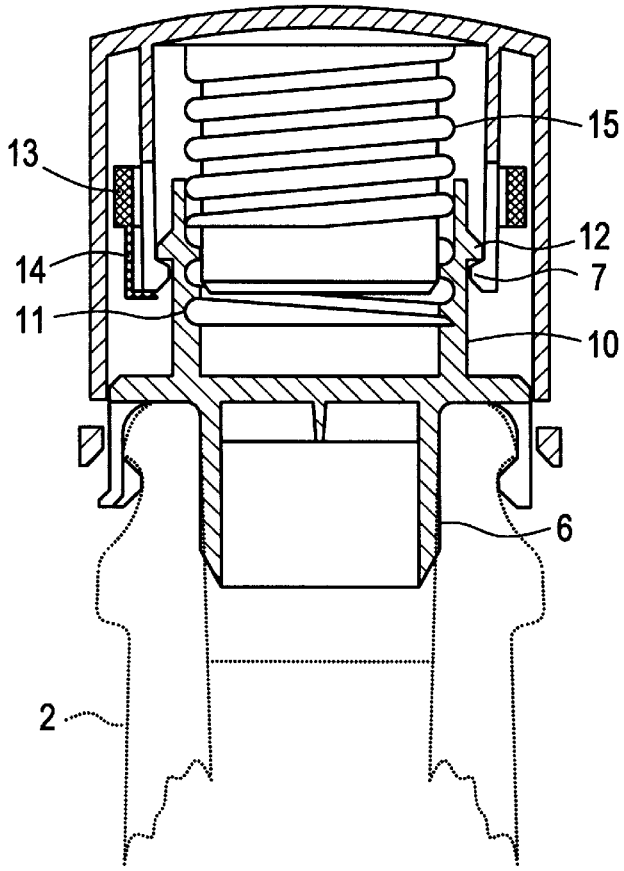

Making reference to the numbering used in the figures, we can see how the airtight stopper, which the invention proposes, just as it is more especially shown in FIG. 1, includes a part that materializes the stopper itself (1) that fits on the neck (2) of the bottle or container, and the independent part materialized by the cap (3) supporting the sealing ring (4).

Figure 5:
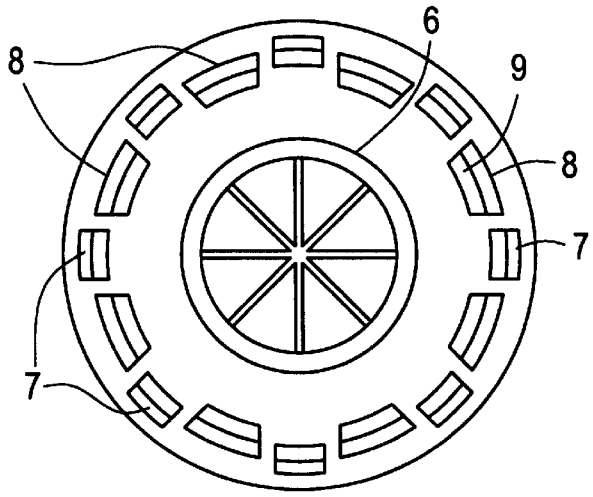
FIG. 5 is a bottom view of FIG. 4.

The stopper (1) is comprised by the discoidal surface (5) from which descends coaxially the cylindrical neck (6) that fits inside the mouth of the bottle or container (2). On the periphery of this discoidal surface (5) there are axial lugs (7) and (8) distributed in the way shown in FIG. 5. The axial lugs (8) have an inside projection (9) that fits in the outside ring-shaped recess of the neck of the bottle or container (2), as one can clearly see in FIG. 1.

Above the discoidal surface (5) of the stopper itself (1), the tubular portion (10) is provided with a bottom thread (11) and an outside ring-shaped projection (12) with stop functions for the movement of the cap (3) as we will see hereinafter. In the top part of the tubular portion (10) there is the ring-shaped part (13) connected to the rest of the stopper by the breakable ribs (14).

On its part, the cap (3) has the threaded axial projection (15) to connect the thread (11) of the tubular portion (10) of the stopper itself, also having some axial lugs (16) provided on their free end with a spear tip (17). The enveloping cylindrical wall is referred to as number (18) and on its free edge there is the sealing ring (4) connected by the breakable ribs (19).

Figure 6:
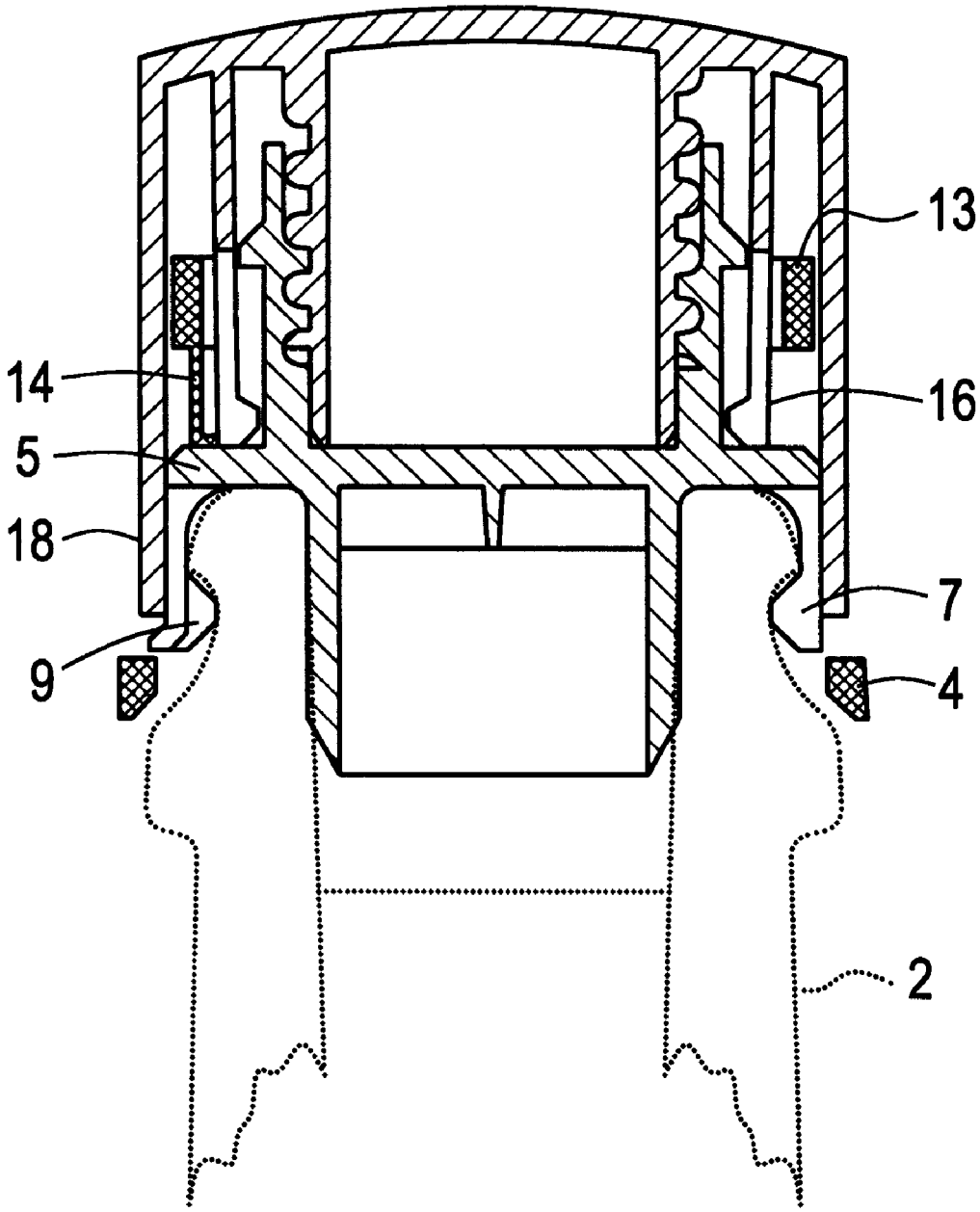
FIG. 6 is the subsequent assembly position of the two component parts of the stopper.
Figure 7:
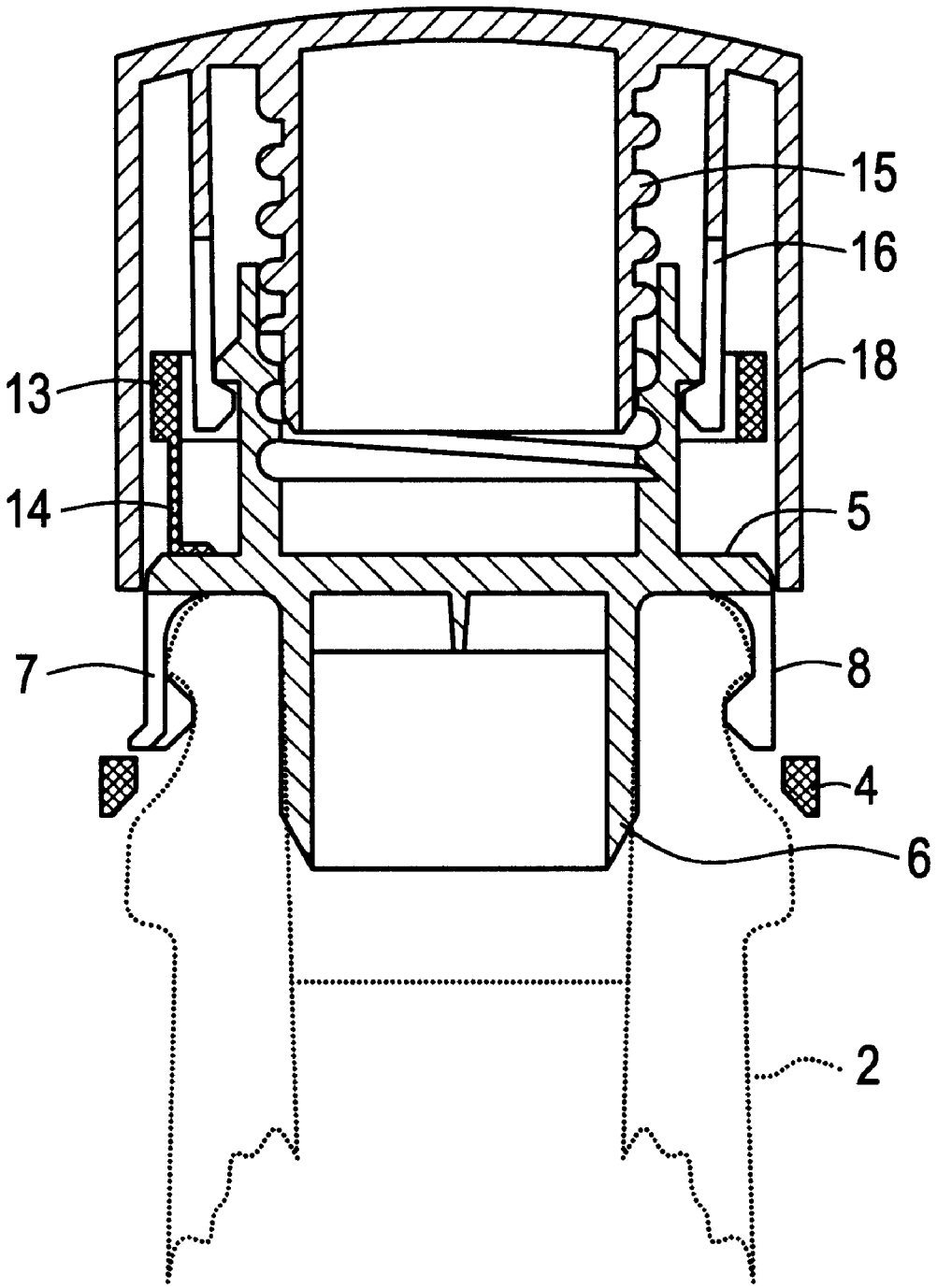
FIG. 7 is a view similar to that of FIG. 6, corresponding to the position of the cap that allows removal of the stopper from the container or bottle, once the sealing ring has been broken.

With this arrangement, in the bottling factory the initial sealing of the container or bottle (2) is proceeded with by placing the stopper itself (1) as is seen in FIG. 1. Hereinafter, the cap (3) is assembled as shown in FIGS. 2, 3, 4 and 6. One can see in FIG. 3 how the spear tipped ends (17) of the axial lugs (16) of the cap (3) abut against the sloped bevel edge of the ring-shaped projection (12) of the tubular portion (10) of the stopper itself (1), springing elastically in order to remain behind it as one can see in FIG. 4. The axial tongues (16) cannot be radially separated because it is prevented by the ring-shaped part (13) that remains placed between them and the covering (18) of the cap. In the initial assembly of the cap (3), the tearable ribs (14) of this ring-shaped part (13) break, and the same moves ending up contacting with the discoidal surface (5) of the stopper itself (1), when the cap is totally assembled, as indicated in FIG. 6.

In FIG. 6 one can also see how the sealing ring (4) of the cap (3) remains retained by the axial lugs (7) of the stopper (1), the complementary threaded areas of the tubular portion (10) and of the axial projection (15) also being interconnected. The outside covering (18) of the cap (3) firmly surrounds the tongues (7) and (8) of the stopper itself (1), forcing the inside projections (9) of the axial tongues (8) to remain in the inside of the ring-shaped recess of the bottle or container (2), not being able to come off although the pressure rises in the inside of the bottle.

In these conditions shown in FIG. 6, when the bottle or container (2) is opened, an operation that is done by unscrewing the cap (3), first of all the axial ribs (19) of the sealing ring (4) break and then the cap (3) rises until the spear tipped projections (17) of the axial tongues (16) of the same, abut against the ring-shaped projection (12) of the tubular portion (10) of the stopper itself (1), in the highest point of its path, which coincides with the end of the thread. Upon the retaining tongues (8) remaining released, one can proceed with the total separation of the stopper from the bottle or container (2). Thus one can proceed to open and close the container repeatedly given that, although the sealing ring (4) has been broken, once the cap (3) is screwed back completely, a position similar to FIG. 6 is reached inasmuch as the lugs (8) are covered by the covering (18), preventing the stopper from being able to accidentally come off.

Figure 8:
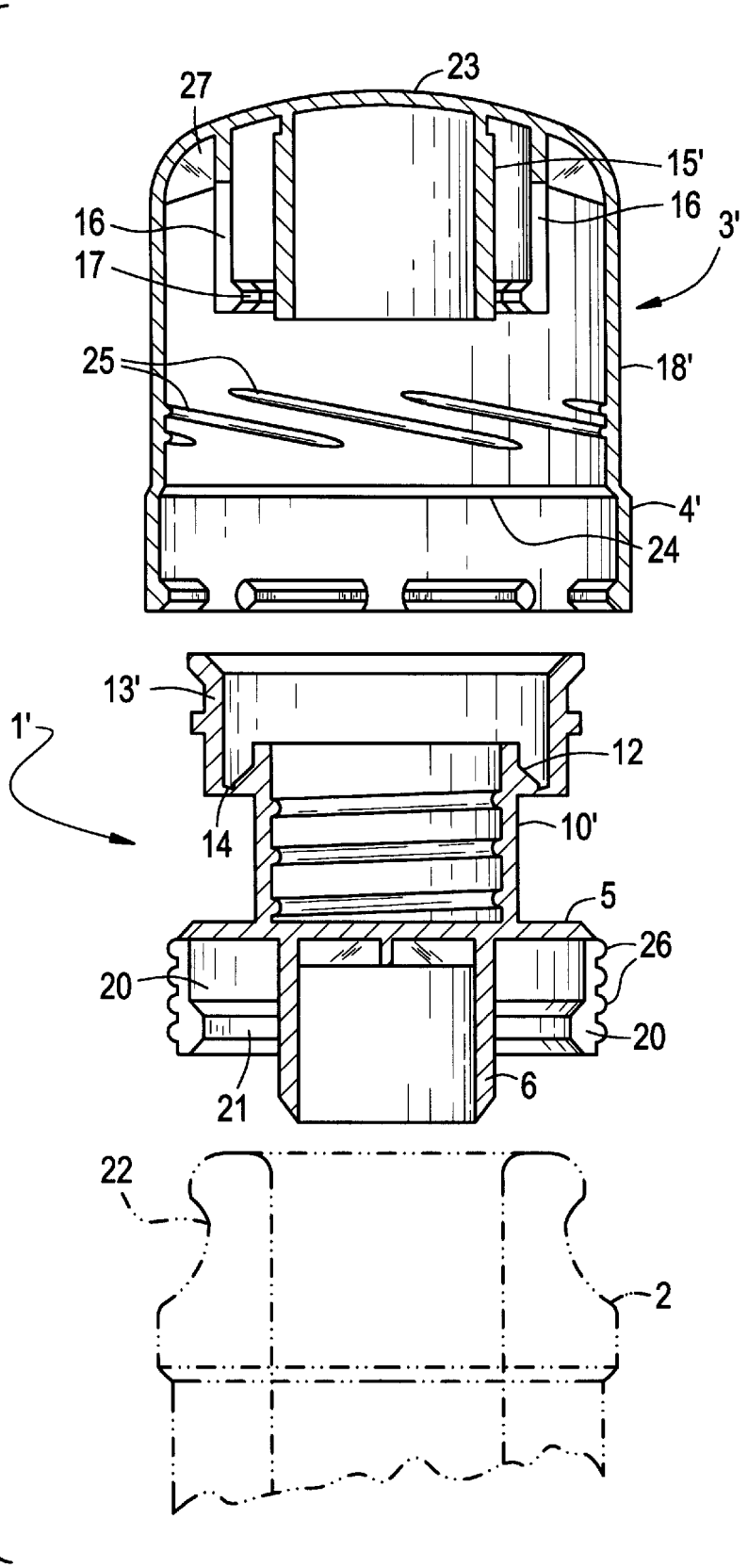
FIG. 8 is a section view that shows in an exploded manner the two component parts of the airtight seal, object of the invention, also showing in an exploded manner a portion of the neck of the bottle or container containing the carbonated beverage.
Figure 9:
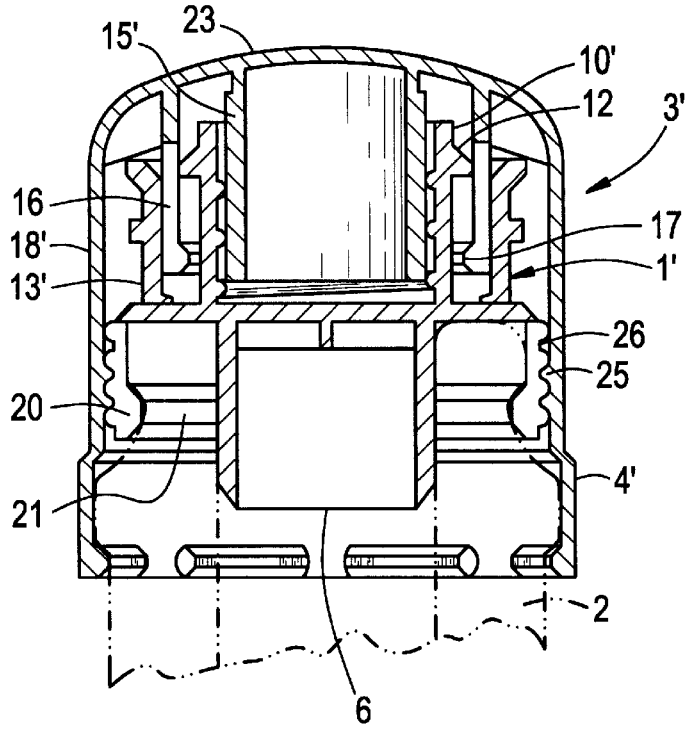
FIG. 9 is a longitudinal raised section view of the same stopper of FIG. 8, now coupled to the bottle and with the guarantee seal that ensures the inviolability of the contents.
Figure 10:
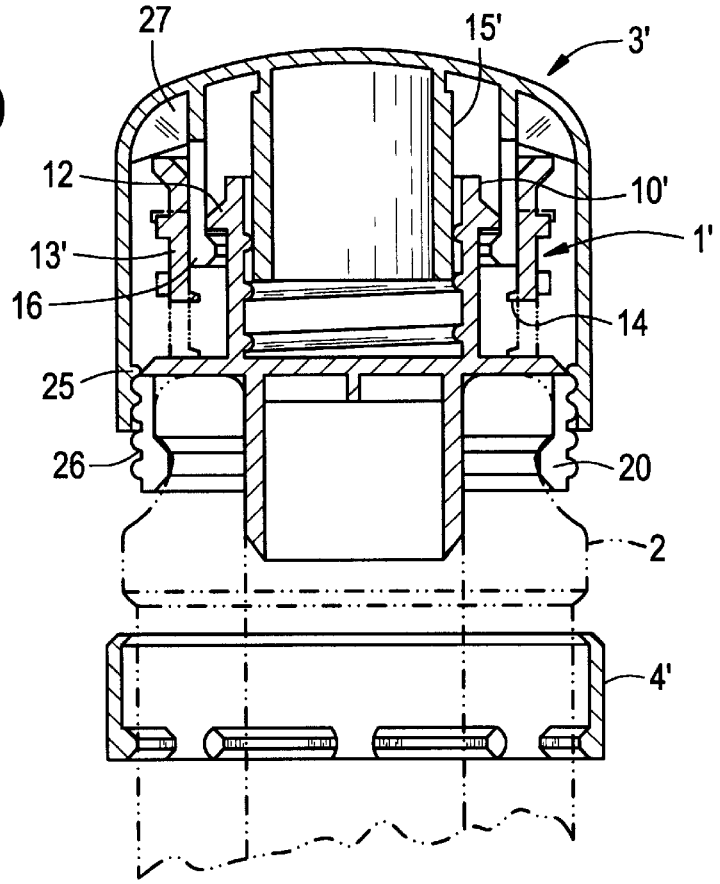
FIG. 10 is a view similar to FIG. 9, once the cap has been unscrewed in order to proceed to break the seal and subsequently open the stopper by axial traction of the assembly, this position in which the airtight closing of the container being able to take place again.

Making special reference to FIGS. 8 to 10, we can see a second embodiment of the structure of the airtight stopper, where the references that designate the common modified elements are accompanied by the suffix "'" (prime). The outside covering of the main body (1') of the stopper, coaxial to the cylindrical neck (6) sealing the contents of the bottle has a plurality of axial cuts to form the retaining tongues (20) or tongues identical to each other and that have the inside projection (21) that is housed in the ring-shaped recess (22) of the outside of the neck of the bottle (2).

Reference (13') designates the ring-shaped part that groups the axial tongues (16) of the cap, in the assembled condition of the assembly.

The cap (3') has the side wall (18') and a top wall (23) or bottom of the same. The sealing ring is referred to in this case as (4') and it is connected to the edge of the side wall (18') by means of some axial breakable ribs that define the frangible line (24). The cylindrical neck (15') that emerges from the bottom (23) is smooth and fits telescopically in the tubular portion (10') of the main body (1), which can be smooth although in this illustrated embodiment it has a helicoidal ridge to optimize guiding.

The cap (3') has inside thread (25) with various ridges and that connect with the thread existing on the outside of all the retaining tongues (20) of the main body (1'), this thread being referred to as number (26). When the unscrewing finishes, the cap can idle, although overcoming a certain resistance.

With this arrangement, in the packaging factory the container or bottle (2) is initially closed with the stopper itself or the main body (1), or (1'), so that the cylindrical neck (6) seals the neck of the bottle (2), then assembling the cap (3), or (3'), so that the assembly adopts the position shown in FIG. 9, taking place in this axial movement: the pulling of the ring-shaped part (13), or (13') by breaking the axial ribs (14) upon the tongues (16) of the cap (3, 3') impinging on them, or else, by the pressure exerted by the edge of the small partitions (27) existing between them and the side wall of the cap (3'), upon pressing on the top edge of said ring-shaped part (13, 13'); the location of the threaded portion (25) of the cap (3') on the outside thread (26) of the retaining tongues (20); and the correct location of the sealing ring (4') with regard to the profile of the neck of the bottle. As one can see in FIG. 9, the tongues (16) of the cap (3') have surpassed the ring-shaped rib (12) of the tubular portion (10) of the main body (1') and are situated in the inside of the ring-shaped part (13'). In this same axial movement, the cylindrical neck (15') of the inside of the cap (3') is inserted tightly inside the top tubular portion (10') of the main body (1').

The stopper assembly hermetically and securely closes the mouth of the container or bottle (2), given that the bottom edge of the cap (3, 3') hides and blocks the retaining tongues (20) (or axial lugs (8) provided with the projection (9) of the embodiment corresponding to FIGS. 1 to 7), preventing removal of the stopper.

When the seal of the container is broken, that is to say, when the stopper is opened for the first time, upon unscrewing the cap the axial ribs of the sealing ring (4') break and this ring remains resting on the neck of the container or bottle (2), as one can see in FIG. 10. The unscrewing takes place until the inside projections (17) of the tongues (16) of the cap (3') knock against the ring-shaped projection (12) of the tubular portion (10') of the main body (1'), this position which corresponds with the one shown in FIG. 10 and very similar to the one shown in FIG. 7, although in the latter case detachment of the sealing ring (4) takes place upon remaining retained in the other tongues (7) that are inserted between the retainers (8). The two component parts of the stopper cannot be totally separated because the tongues (16) are deprived of angular movement towards the outside due to the existence of the ring-shaped part (13, 13') that blocks them in this direction and therefore the ring-shaped dentation (12) cannot be surpassed.

The separation of the stopper upon opening the bottle, is produced by axial traction since the retaining tongues (20), or (8), can open angularly towards the outside so that their projections (21) come out of the ring-shaped recess (22) of the neck (2), task which is facilitated by the sloped arrangement of the top or inside part of said projections.

If the sparkling contents of the bottle (2) has not been consumed in the same position in which the stopper assembly has been removed, the bottle is closed by axial pressure until the position of FIG. 10 is occupied again. Then the screwing on of the cap up to the stop is then proceeded with and thus the retaining tongues (20) are blocked, thus preventing accidental opening thereof, as if the seal on the bottle had not been broken for the first time, these operations being possible as many times as necessary until the entire liquid content has been consumed, without reducing the proposed characteristics of airtightness and secure closing.

As one can see in FIG. 9, the sealing ring (4') before the seal is broken, occupies a position that ensures Inviolability due to the fact that it remains retained by its bottom edge on the neck (2) and when the cap (3') is unscrewed, the axial ribs that comprise the frangible line (24) unavoidably broken. The effectiveness of the closing is carried out due to the close fitting and interconnection the broadest part of the stopper, between the cap and the retaining tongues (20) that remain pressed and blocked against the neck of the bottle (2). Undesired lateral movement and above all a fraudulent operation of trying to separate the stopper assembly from the container are prevented, due to the above mentioned close fitting, as well as to the penetration of the sealing neck (6) into the inside of the neck, and due to the telescopic fitting in the top part of the stopper, between the cap (3') and the main body or stopper itself (1'), upon the respective telescopic parts (10') and (15') sliding tightly, which is also contributed to by the sliding fit of the top tongues (16) between the ring-shaped part (13') and the cylindrical portion (10'), as one can infer upon observing this FIG. 9 which we are considering.

The movement of the cap (3') with regard to the stopper itself (1') is carried out as it has been indicated above by screwing or unscrewing the cap, which takes place simply by turning a fourth of a turn, since the thread system, as shown in FIG. 8, has in this case multiple ridges.

What is claimed is:

1. An airtight stopper for containers and bottles, comprising:

a stopper portion and a cap, said cap portion adapted for arrangement on said stopper portion, wherein said stopper portion comprises:

a central neck adapted for insertion in a bottle;

an outside covering having a lower surface attached to an upper surface of the central neck, said outside covering being adapted to remain external to the bottle when the central neck is inserted in the bottle;

said outside covering includes retaining means adapted for retaining said central neck in the bottle by contacting an external surface of the bottle; and a tubular portion attached to an upper surface of said outside covering, said tubular portion being arranged in an axial direction of said central neck, and includes an outside ring-shaped stopping projection; and a detachable ring-shaped part attached to an upper portion of the tubular portion above the outside ring-shaped projection; and wherein said cap comprises:

a sealing ring means comprising a sealing ring arranged at a lower end of said cap so as to be disposed below a lower end of said retaining means to initially seal said cap to said stopper portion;

blocking means for blocking movement of said retaining means away from the external surface of the bottle;

axial tongues having spear tips at a lower end so that said spear tips are guided by said detachable ring-shaped part for contact with said outside ring-shaped stopping portion, said spear tips and said outside ring-shaped stopping projection provide limited movement of said cap in an axial path for opening and closing of said airtight stopper after said sealing ring has been broken, and wherein the ring-shaped part forms part of the stopper, and is initially connected to the edge of the ring-shaped projection of the tubular portion by breakable rib means which detach in the assembly of the cap in a bottling operation, so that said ring shaped part surrounds the axial tongues and is housed in a ring-shaped space formed between the tongues and a cylindrical wall of the cap.

2. The device according to claim 1, wherein the cap has a threaded axial projection for connection inside of a threaded interior of the tubular portion of a main body of the airtight stopper.

3. The device according to claim 1, wherein said retaining means comprises retaining tongues and wherein the inside edge of the cap comprises a thread that connects with an existing thread on an outside of the retaining tongues of said retaining means that emerge from a main body of the airtight stopper.

4. The device according to claim 3, wherein the axial path of the cap is guided during a forward and backward movement by threads of the tubular portion that emerges from an upper part of the stopper portion and said cap includes a top neck portion that emerges from a bottom of the cap and fits telescopically with the tubular portion.

5. The device according to claim 3, wherein said thread has several ridges for blocking and releasing positions of the retaining tongues with turns of a fourth of a turn.

6. The device according to claim 5, wherein the axial path of the cap is guided during a forward and backward movement by thread of the tubular portion that emerges from an upper part of the stopper portion and said cap includes a top neck portion that emerges from a bottom of the cap and fits telescopically with the tubular portion.

7. An airtight stopper for containers and bottles, comprising:

a stopper portion and a cap, said cap portion adapted for arrangement on said stopper portion, wherein said stopper portion comprises:

a central neck adapted for insertion in a bottle;

an outside covering having a lower surface attached to an upper surface of the central neck, said outside covering being adapted to remain external to the bottle when the central neck is inserted in the bottle;

said outside covering includes retaining means adapted for retaining said central neck in the bottle by contacting an external surface of the bottle; and a tubular portion attached to an upper surface of said outside covering, said tubular portion being arranged in an axial direction of said central neck, and includes an outside ring-shaped stopping projection; and a detachable ring-shaped part attached to an upper portion of the tubular portion above the outside ring-shaped projection; and wherein said cap comprises:

a sealing ring means comprising a sealing ring arranged at a lower end of said cap so as to be disposed below a lower end of said retaining means to initially seal said cap to said stopper portion;

blocking means for blocking movement of said retaining means away from the external surface of the bottle;

axial tongues having spear tips at a lower end so that said spear tips are guided by said detachable ring-shaped part for contact with said outside ring-shaped stopping portion, said spear tips and said outside ring-shaped stopping projection provide limited movement of said cap in an axial path for opening and closing of said airtight stopper after said sealing ring has been broken, and wherein the cap has a threaded axial projection for connection inside of a threaded interior of the tubular portion of a main body of the airtight stopper.

8. An airtight stopper for containers and bottles, comprising:

a stopper portion and a cap, said cap portion adapted for arrangement on said stopper portion, wherein said stopper portion comprises:

a central neck adapted for insertion in a bottle;

an outside covering having a lower surface attached to an upper surface of the central neck, said outside covering being adapted to remain external to the bottle when the central neck is inserted in the bottle;

said outside covering includes retaining means comprising retaining tongues adapted for retaining said central neck in the bottle by contacting an external surface of the bottle; and a tubular portion attached to an upper surface of said outside covering, said tubular portion being arranged in an axial direction of said central neck, and includes an outside ring-shaped stopping projection; and a detachable ring-shaped part attached to an upper portion of the tubular portion above the outside ring-shaped projection; and wherein said cap comprises:

a sealing ring means comprising a sealing ring arranged at a lower end of said cap so as to be disposed below a lower end of said retaining means to initially seal said cap to said stopper portion;

blocking means for blocking movement of said retaining means away from the external surface of the bottle;

axial tongues having spear tips at a lower end so that said spear tips are guided by said detachable ring-shaped part for contact with said outside ring-shaped stopping portion, said spear tips and said outside ring-shaped stopping projection provide limited movement of said cap in an axial path for opening and closing of said airtight stopper after said sealing ring has been broken, and wherein the inside edge of the cap comprises a thread that connects with an existing thread on an outside of the retaining tongues of said retaining means that emerge from a main body of the airtight stopper.

9. The device according to claim 8, wherein said thread has several ridges for blocking and releasing positions of the retaining tongues with turns of a fourth of a turn.

10. The device according to claim 9, wherein the axial path of the cap is guided during a forward and backward movement by thread of the tubular portion that emerges from an upper part of the stopper portion and said cap includes a top neck portion that emerges from a bottom of the cap and fits telescopically with the tubular portion.

11. The device according to claim 8 wherein the axial path of the cap is guided during a forward and backward movement by threads of the tubular portion that emerges from an upper part of the stopper portion and said cap includes a top neck portion that emerges from a bottom of the cap and fits telescopically with the tubular portion.

* * * * *